US006894299B2

(12) United States Patent
Harrell et al.

(10) Patent No.: US 6,894,299 B2
(45) Date of Patent: May 17, 2005

(54) APPARATUS AND METHOD FOR TREATING PRODUCTS WITH ULTRAVIOLET LIGHT

(75) Inventors: Gregory W. Harrell, Clyde, OH (US); James M. Borsuk, Westlake, OH (US)

(73) Assignee: Nordson Corporation, Westlake, OH (US)

( * ) Notice: Subject to any disclaimer, the term of this patent is extended or adjusted under 35 U.S.C. 154(b) by 42 days.

(21) Appl. No.: 10/675,080

(22) Filed: Sep. 30, 2003

(65) Prior Publication Data

US 2004/0065852 A1 Apr. 8, 2004

Related U.S. Application Data

(60) Provisional application No. 60/415,793, filed on Oct. 3, 2002.

(51) Int. Cl.[7] ..... H05B 35/00

(52) U.S. Cl. ..... 250/504 R; 250/455.11; 359/351

(58) Field of Search ..... 250/453.11–455.11, 250/492.1, 492.2, 493.1, 494.1, 503.1, 504 R; 359/350–351, 361

(56) References Cited

U.S. PATENT DOCUMENTS 3,769,517 A * 10/1973 Coleman ..... 250/455.11
3,790,801 A * 2/1974 Coleman ..... 250/453.11
4,011,456 A * 3/1977 Bredewater et al. ..... 250/492.1
5,013,924 A * 5/1991 Armstrong et al. ..... 250/504 R
6,807,906 B1 * 10/2004 DeMoore et al. ..... 101/424.1

* cited by examiner

*Primary Examiner*—John D. Lee
(74) *Attorney, Agent, or Firm*—Wood, Herron & Evans, L.L.P.

(57) ABSTRACT

Apparatus and method for treating a product with ultraviolet light. The apparatus includes a chamber having an inlet and an outlet, and an interior space between the inlet and the outlet. An ultraviolet light permeable conveyor is configured to move the product through the interior space from the inlet to the outlet. The conveyor has a top surface which receives the product and an opposite bottom surface. A source of ultraviolet light is coupled to the chamber and is configured to direct ultraviolet light in at least first and second portions within the interior space toward the conveyor. A first reflector is positioned in the interior space and above the top surface of the conveyor such that the first portion of the ultraviolet light is redirected toward the product on the top surface. A second reflector is positioned in the interior space and below the bottom surface of the conveyor such that the second portion of the ultraviolet light is redirected upwardly through the conveyor toward the product on the top surface.

24 Claims, 3 Drawing Sheets

APPARATUS AND METHOD FOR TREATING PRODUCTS WITH ULTRAVIOLET LIGHT

CROSS-REFERENCE TO RELATED APPLICATIONS

This application claims the benefit of U.S. Provisional Application No. 60/415,793 filed on Oct. 3, 2002, and the disclosure of which is hereby incorporated by reference herein.

FIELD OF THE INVENTION

This invention generally relates to curing materials on a substrate or product by application of ultraviolet radiation from one or more ultraviolet lamps. More particularly, the invention relates to such curing processes used in a high speed production environment.

BACKGROUND OF THE INVENTION

Various materials, such as inks or adhesives, or other materials, are cured by application of ultraviolet radiation from one or more ultraviolet lamps. It is also well known to provide each lamp in an assembly with a reflector which includes a reflective surface partly surrounding a lamp for reflecting radiation from the lamp onto the substrate. Typically, the reflective surface has a concave profile which is commonly elliptical or parabolic, the lamp being mounted on the symmetrical center line of the profile and adjacent the apex. The reflector increases the intensity of the radiation received by the curable material. In general, the higher the intensity of the radiation the better the penetration into the material. This results in faster, more complete curing of the material.

To achieve higher light intensity, or a larger amount of radiation exposure, multiple lamps have been used for directing ultraviolet light onto, for example, a moving product in a high speed production environment. Increasing the intensity or amount of light which reaches the substrate or product in a given amount of time results in increased productivity or throughput. Unfortunately, increasing the number of lamp assemblies results in various undesirable consequences. For example, the use of multiple lamp assemblies increases power consumption and, therefore, the cost of using the curing apparatus, and also increases the size of the apparatus and, therefore, the floorspace requirements.

For these reasons, as well as others, it would be desirable to provide an apparatus and method for curing or otherwise treating products with ultraviolet light in a high speed production environment, while reducing the number of ultraviolet lamps needed, as well as reducing the power consumption and floor space requirements.

SUMMARY OF THE INVENTION

The present invention is generally directed to apparatus and methods for treating a product with ultraviolet light. The apparatus allows for a greater dispersion of the light with a smaller amount of generated light in a production environment which utilizes a conveyor. The apparatus includes a chamber having an inlet and an outlet, and an interior space between the inlet and the outlet. An ultraviolet light permeable conveyor is configured to move the product through the interior space from the inlet to the outlet. The conveyor includes a top surface which receives the product and an opposite bottom surface. A source of ultraviolet light is coupled to the chamber and directs at least a first portion of ultraviolet light within the interior space through the conveyor. A first reflector is positioned on an opposite side of the conveyor from the source of ultraviolet light and such that the first portion of ultraviolet light is redirected through the conveyor at the product on the top surface. In another aspect of the invention, at least one additional reflector is positioned on an opposite side of the conveyor from the first reflector and redirects ultraviolet light from the source onto the product. In the preferred embodiment, the source of ultraviolet light is positioned above the conveyor and the first reflector is positioned below the top surface of the conveyor, such as between upper and lower conveyor portions of an endless conveyor belt. In this case, the additional reflector is positioned above the top surface of the conveyor.

When the apparatus includes the additional reflector noted above, it may be positioned generally along a first side edge of the conveyor such that ultraviolet light from the source is redirected transversely relative to the length of the conveyor toward the product on the top surface. A third reflector may also be positioned in the interior space generally along a second side edge of the conveyor such that ultraviolet light is redirected transversely relative to the length of the conveyor toward the product on the top surface.

One or more of the reflectors used in the apparatus may be position adjustable in order to optimize the reflection of light onto the product. The reflector(s) may be made of any reflective material, but a highly polished dimpled aluminum material is presently preferred. The reflector(s) may be angled or sloped, or they may be curved in various manners depending on the desired reflective properties.

A method of treating a product with ultraviolet light according to the invention includes moving an ultraviolet light permeable conveyor through a chamber with the product carried on the top surface of the conveyor. A first portion of ultraviolet light is directed at the product. A second portion of ultraviolet light is also directed through the conveyor. The second portion is reflected back through the conveyor and toward the product. In the preferred embodiment, the second portion of ultraviolet light is directed from above the top surface of the conveyor through the conveyor and then reflected upwardly back through the conveyor at the bottom of the product.

In another aspect of the method, a third portion of ultraviolet light is directed adjacent to the outer perimeter of the product and that third portion is reflected toward the product in a generally sideways direction transverse to the length of the conveyor. A fourth portion of the ultraviolet light can also be directed adjacent to the outer perimeter of the product on an opposite side of the product from the third portion and then reflected toward the product in a generally sideways direction transverse to the length of the conveyor. The light may be directed with the conveyor in either a stopped condition or with the conveyor continuously moving, although continuously moving the conveyor is preferred in order to speed production. The treatment accomplished with the ultraviolet light can be a curing operation such as the curing of an adhesive or other material.

These and other features, advantages and objectives of the invention will become more readily apparent to those of ordinary skill in the art upon review of the following detailed description of the preferred embodiments, taken in conjunction with the accompanying drawings.

DETAILED DESCRIPTION OF THE PREFERRED EMBODIMENTS

Figure 1:
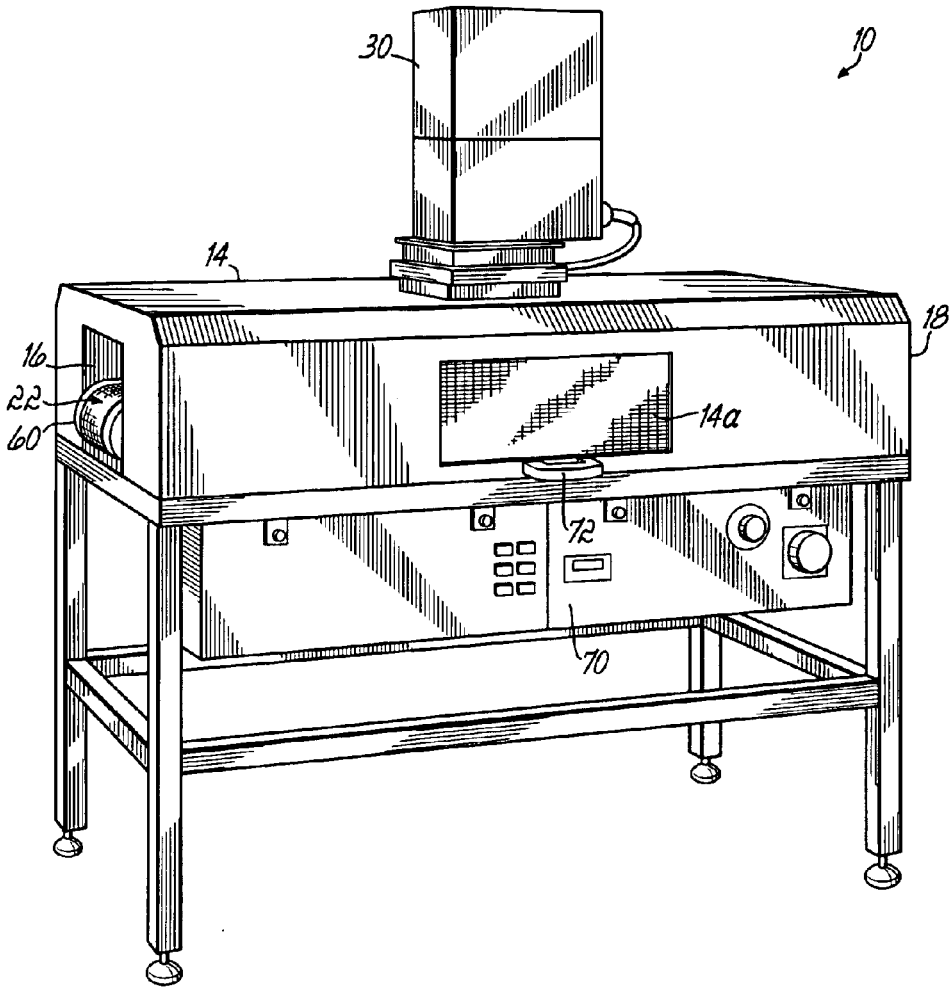
FIG. 1 is a perspective view illustrating an ultraviolet light treatment apparatus constructed in accordance with the preferred embodiment of this invention.
Figure 2:
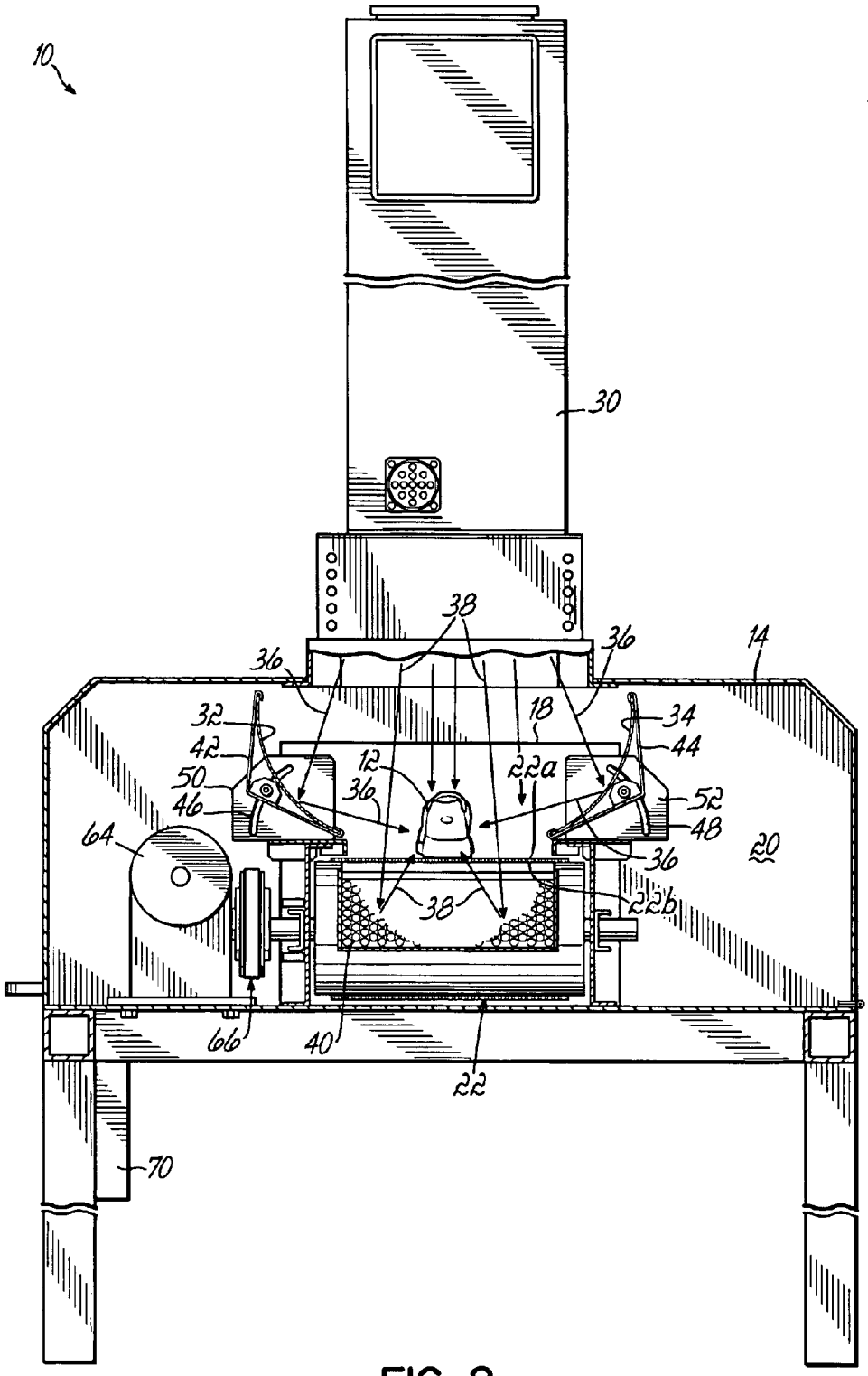
FIG. 2 is a transverse cross sectional view of the apparatus shown in FIG. 1.
Figure 3:
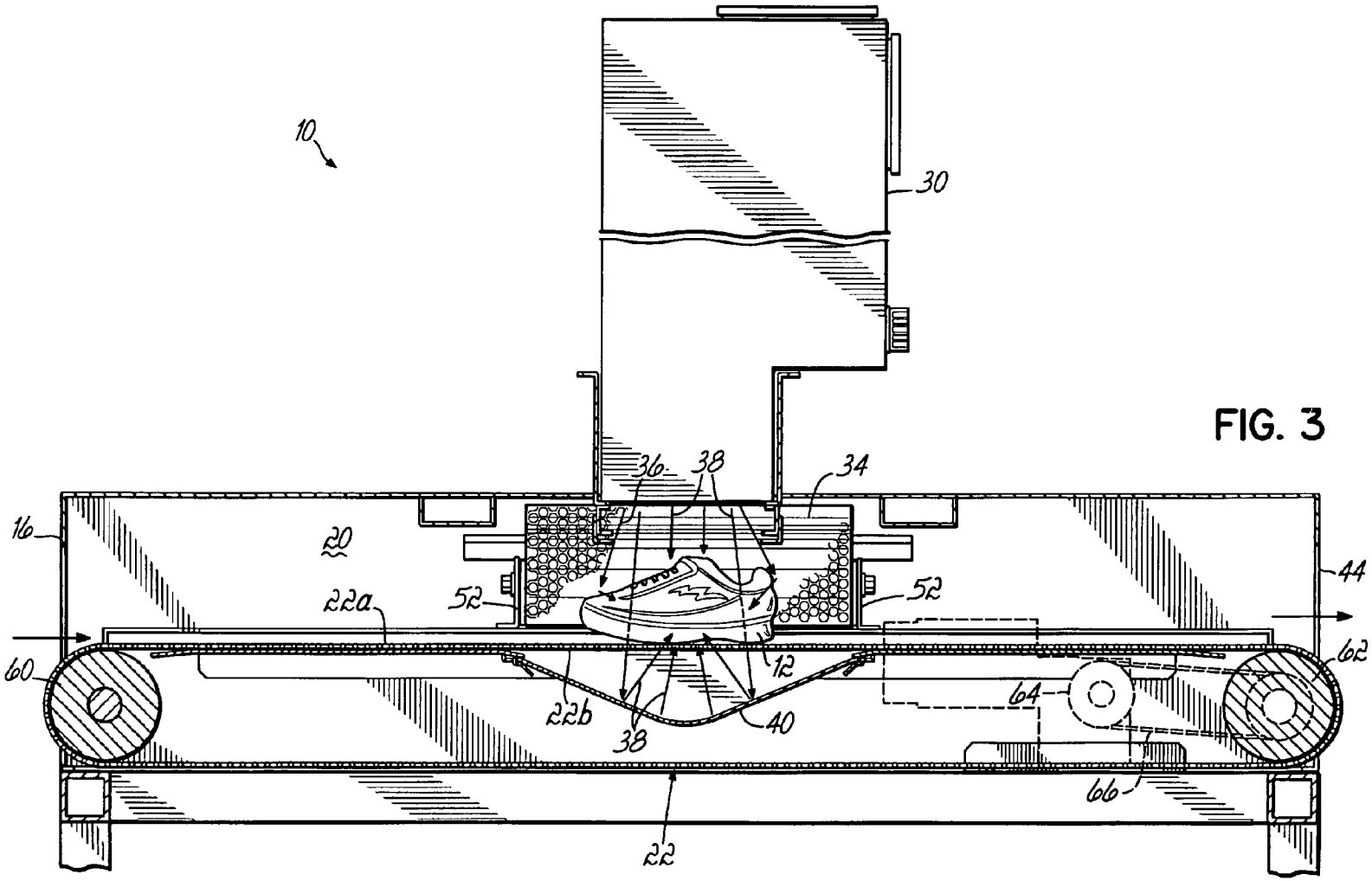
FIG. 3 is a longitudinal cross sectional view of the apparatus shown in FIG. 1.

Referring to FIGS. 1–3, an apparatus 10 is shown for treating a product 12, such as a consumer product, intermediate manufacturing product, or another type of product, with ultraviolet light. As used herein, the terms "light" and "radiation" are used interchangeably. The apparatus 10 may be used for curing ultraviolet light curable materials, such as inks or adhesives, or may be used for other treatments which require ultraviolet light. The apparatus 10 includes a chamber 14 having an inlet 16, an outlet 18, and an interior space 20 between the inlet 16 and the outlet 18. An ultraviolet light permeable conveyor 22, which may be formed of a Teflon™ mesh material, is mounted within the chamber 14 to move the product 12 through the interior space 20 from the inlet 16 to the outlet 18. Preferably, the mesh material is preferably 80%–90% open to allow significant amounts of ultraviolet light to pass through the conveyor 22. The conveyor 22 includes a top surface 22*a* which receives the product 12 and an opposite bottom surface 22*b*.

A source 30 of ultraviolet light is coupled to the chamber 14 and is configured to direct ultraviolet light generally in first and second portions within the interior space 20 toward the conveyor 22. A pair of opposed side reflectors 32, 34 are positioned in the interior space 20 above the top surface 22*a* of the conveyor 22 such that a first portion of the ultraviolet light, as indicated by arrows 36, is reflected and redirected toward the product 12 on the top surface 22*a* of the conveyor 22. A second portion of the ultraviolet light, as indicated by arrows 38, passes through the conveyor 22 and is reflected and redirected upwardly through the conveyor 22 by a lower reflector 40. The ultraviolet light source 30, such as a microwave-powered lamp assembly, is mounted to the top of the chamber 14 such that the ultraviolet light is directed generally vertically downward. The ultraviolet light source or lamp assembly 30 may, for example, be either a CoolWave 6 or a CoolWave 10 microwave-powered lamp assembly, and may be obtained from Nordson Corporation, in Westlake, Ohio. Other types of ultraviolet light sources may be used instead, such as those utilizing electrodes instead of microwave power sources.

The side reflectors 32, 34 are preferably elliptical in shape, or curved otherwise as necessary or desired for the application, and are connected to respective support structure 42, 44 for retaining the reflectors 32, 34. The support structure 42, 44 is mounted for adjustable movement along respective slots 46, 48 in frame members 50, 52. The lower reflector 40 is preferably angled in a generally V-shaped manner as shown best in FIG. 3 so as to reflect ultraviolet light or radiation upwardly through conveyor 22 to the bottom surface of the product 12. Although not shown to be adjustable, this lower reflector 40 may also be adjustable either angularly or heightwise or both, in order to adjust the focus position. Alternatively or additionally, this reflector 40 and/or side reflectors 32, 34 may be replaced by other reflectors having different characteristics.

The conveyor 22 is an endless conveyor mounted to respective rollers 60, 62 (FIG. 3) positioned generally at the inlet 16 and the outlet 18 of the chamber 14. One of the rollers 62 is driven by a motor 64 and belt assembly 66. The lower reflector 40 is positioned between the upper and lower portions of the conveyor 22 which extend between the two rollers 60, 62. The microwave lamp assembly control 70 (FIG. 1) is operated by a standard programmable logic controller (PLC) which controls the lamp assembly 30 in a known manner. The PLC also controls the conveyor 22 in an on/off fashion and also adjusts the speed of the conveyor 22. The speed adjustment may either be manual, i.e., made by the operator directly, or it may be automatic so as to be controlled by other components (not shown) in the production line. In addition, adjustment in the speed of the conveyor 22 may automatically change the power supply to the lamp assembly 30 so as to increase or decrease radiation intensity, to correspond with increases and decreases in conveyor speed. Chamber 14 may be hinged at the back in order to allow it to be lifted by way of a handle 72 in the front for maintenance, inspection, etc. A window 14*a* is also provided for allowing observation or inspection of the interior space 20.

In the preferred embodiment, multiple products 12 are continuously moved past the lamp assembly 30 and reflectors 32, 34, 40, however, it is also within the scope of this invention to stop the conveyor 22 below the lamp assembly 30 for a period of time during the curing operation. The conveyor 22 could also be an edge conveyor or other type of conveyor as long as a sufficient amount of light passes through the conveyor to reach the lower reflector 40. The reflectors 32, 34, 40 are preferably highly polished aluminum, and dimpled, to achieve maximum reflection of the radiation or light. Other reflective materials are also within the scope of this invention. The specific application shown and described herein is with respect to securing the sole of a shoe 12 with an ultraviolet light curable adhesive. However, it will be appreciated that the invention may be applied in many applications in which a product is being treated by ultraviolet light or radiation.

While the present invention has been illustrated by a description of various preferred embodiments and while these embodiments has been described in some detail, it is not the intention of the Applicants to restrict or in any way limit the scope of the appended claims to such detail. Additional advantages and modifications will readily appear to those skilled in the art. The various features of the invention may be used alone or in numerous combinations depending on the needs and preferences of the user. This has been a description of the present invention, along with the preferred methods of practicing the present invention as currently known. However, the invention itself should only be defined by the appended claims, wherein we claim:

What is claimed is:

1. Apparatus for treating a product with ultraviolet light, comprising:

a chamber having an inlet and an outlet, and an interior space between said inlet and said outlet;

an ultraviolet light permeable conveyor configured to move the product through said interior space from said inlet to said outlet, said conveyor having a top surface which receives the product and an opposite bottom surface;

a source of ultraviolet light coupled to said chamber and configured to direct ultraviolet light in at least first and second portions within said interior space toward said conveyor;

a first reflector positioned in said interior space and above said top surface of said conveyor, said first reflector positioned such that the first portion of the ultraviolet light is redirected toward the product on said top surface; and a second reflector positioned in said interior space and below said bottom surface of said conveyor, said second reflector positioned such that the second portion of the ultraviolet light is redirected upwardly through said conveyor toward the product on said top surface.

2. The apparatus of claim 1, further comprising a third reflector positioned in said interior space and adjacent said top surface of said conveyor on an opposite side of said conveyor from said first reflector, said third reflector sloped such that the ultraviolet light is redirected toward the product on said top surface.

3. The apparatus of claim 2, wherein said first, second, and third reflectors are formed of a dimpled, polished metal.

4. The apparatus of claim 2, wherein said first and second reflectors are positioned at respective slopes relative to said top surface, and said slopes are adjustable.

5. The apparatus of claim 2, wherein said source of ultraviolet light comprises an ultraviolet lamp assembly mounted above said top surface of said conveyor so as to direct the ultraviolet light generally vertically downward toward said top surface.

6. The apparatus of claim 2, wherein said conveyor further comprises an endless conveyor belt having an upper portion and a lower portion, and said second reflector is positioned between said upper and lower portions.

7. The apparatus of claim 1, wherein said first and second reflectors are formed of a dimpled, polished metal.

8. The apparatus of claim 1, wherein said first reflector is positioned at a slope relative to said top surface, and said slope is adjustable.

9. The apparatus of claim 1, wherein said source of ultraviolet light comprises an ultraviolet lamp assembly mounted above said top surface of said conveyor so as to direct the ultraviolet light generally vertically downward toward said top surface.

10. The apparatus of claim 1, wherein said conveyor further comprises an endless conveyor belt having an upper portion and a lower portion, and said second reflector is positioned between said upper and lower portions.

11. Apparatus for treating a product with ultraviolet light, comprising:

a chamber having an inlet and an outlet, and an interior space between said inlet and said outlet;

an ultraviolet light permeable conveyor configured to move the product through said interior space from said inlet to said outlet, said conveyor having a top surface which receives the product and an opposite bottom surface;

a source of ultraviolet light coupled to said chamber and configured to direct at least a first portion of ultraviolet light within said interior space through said conveyor;

a first reflector positioned on an opposite side of said conveyor from said source of ultraviolet light, said first reflector positioned such that the first portion of ultraviolet light is redirected through said conveyor at the product on said top surface.

12. The apparatus of claim 11, wherein said source of ultraviolet light is positioned above said top surface of said conveyor and said reflector is positioned below said conveyor.

13. The apparatus of claim 11, wherein said conveyor includes opposite side edges extending along a length, and further comprising:

a second reflector positioned in said interior space generally along a first one of said side edges, said second reflector positioned such that a second portion of the ultraviolet light is redirected transversely relative to the length of the conveyor toward the product on said top surface.

14. The apparatus of claim 13, further comprising:

a third reflector positioned in said interior space generally along a second one of said side edges, said third reflector positioned such that a third portion of the ultraviolet light is redirected transversely relative to the length of the conveyor toward the product on said top surface.

15. A method of treating a product with ultraviolet light, the product moving within a chamber and along a conveyor which is permeable to ultraviolet light and includes a top surface, comprising:

moving the conveyor through the chamber with the product carried on the top surface;

directing a first portion of the ultraviolet light at the product;

directing a second portion of the ultraviolet light through the conveyor; and reflecting the second portion of the ultraviolet light back through the conveyor and toward the product.

16. The method of claim 15, further comprising directing the second portion of the ultraviolet light from above the top surface of the conveyor through the conveyor and reflecting the second portion of the ultraviolet light upwardly back through the conveyor at the bottom of the product.

17. The method of claim 16, wherein the product includes an outer perimeter and the conveyor includes a length, and the method further comprises:

directing a third portion of the ultraviolet light adjacent to the outer perimeter of the product; and reflecting the third portion of the ultraviolet light toward the product in a generally sideways direction transverse to the length of the conveyor.

18. The method of claim 17, further comprising:

directing a fourth portion of the ultraviolet light adjacent to the outer perimeter of the product on an opposite side of the product from the third portion; and reflecting the fourth portion of the ultraviolet light toward the product in a generally sideways direction transverse to the length of the conveyor.

19. The method of claim 15, wherein the product includes an outer perimeter and the conveyor includes a length, and the method further comprises:

directing a third portion of the ultraviolet light adjacent to the outer perimeter of the product; and reflecting the third portion of the ultraviolet light toward the product in a generally sideways direction transverse to the length of the conveyor.

20. The method of claim 19, further comprising:

directing a fourth portion of the ultraviolet light adjacent to the outer perimeter of the product on an opposite side of the product from the third portion; and reflecting the fourth portion of the ultraviolet light toward the product in a generally sideways direction transverse to the length of the conveyor.

21. The method of claim 15, further comprising:

stopping the conveyor while the first and second portions of ultraviolet light are directed at the product and through the conveyor.

22. The method of claim 15, further comprising:

continuously moving the conveyor while the first and second portions of ultraviolet light are directed at the product and through the conveyor.

23. The method of claim 15, further comprising:

curing an ultraviolet light curable material on the product with the first and second portions of ultraviolet light.

24. The method of claim 15, further comprising:

curing an ultraviolet light curable adhesive on the product with the first and second portions of ultraviolet light.

* * * * *